US008448275B1

(12) United States Patent
Leach

(10) Patent No.: US 8,448,275 B1
(45) Date of Patent: May 28, 2013

(54) PILLOW ASSEMBLY WITH MULTIPLE CONFIGURATIONS

(76) Inventor: Jamie S. Leach, Ada, OK (US)

( * ) Notice: Subject to any disclaimer, the term of this patent is extended or adjusted under 35 U.S.C. 154(b) by 288 days.

(21) Appl. No.: 13/085,300

(22) Filed: Apr. 12, 2011

(51) Int. Cl.
*A47C 16/00* (2006.01)

(52) U.S. Cl.
USPC ..... 5/655; 5/630; 297/284.5; 297/397

(58) Field of Classification Search
USPC ..... 5/630–632, 652, 655, 657, 657.5, 5/640, 118, 490, 722, 723; 297/284.5, 397, 297/229, 219.1
See application file for complete search history.

(56) References Cited

U.S. PATENT DOCUMENTS

| | | | | |
|---|---|---|---|---|
| 2,857,957 | A | 10/1958 | Gay | |
| 2,952,856 | A * | 9/1960 | Ruff | 5/640 |
| 2,953,793 | A | 9/1960 | Rossi | |
| 3,761,131 | A | 9/1973 | Oliver | |
| 3,775,785 | A | 12/1973 | Mittendorf | |
| 3,924,282 | A | 12/1975 | Bond | |
| 4,171,549 | A | 10/1979 | Morrell et al. | |
| 4,194,254 | A | 3/1980 | Torrez | |
| 4,393,530 | A | 7/1983 | Stark | |
| 4,506,396 | A | 3/1985 | Ritchie, Jr. et al. | |
| 4,528,981 | A | 7/1985 | Behar | |
| 4,550,459 | A | 11/1985 | Endel et al. | |
| 4,654,907 | A | 4/1987 | Haugaard | |
| 4,685,163 | A | 8/1987 | Quillen et al. | |
| 4,826,208 | A | 5/1989 | Ozmar | |
| 4,834,459 | A | 5/1989 | Leach | |
| 4,836,605 | A | 6/1989 | Greenwood et al. | |
| 4,861,109 | A | 8/1989 | Leach | |
| 4,905,330 | A | 3/1990 | Jacobs | |
| D309,018 | S | 7/1990 | Leach | |
| 4,970,742 | A | 11/1990 | Keener | |
| 4,987,625 | A | 1/1991 | Edelson | |
| 5,103,514 | A | 4/1992 | Leach | |
| 5,182,828 | A | 2/1993 | Alivizatos | |
| 5,205,611 | A | 4/1993 | Stephens | |
| 5,216,772 | A | 6/1993 | Clute | |
| 5,272,780 | A | 12/1993 | Clute | |
| 5,297,304 | A | 3/1994 | O'Sullivan | |
| 5,325,818 | A | 7/1994 | Leach | |
| 5,359,739 | A | 11/1994 | Rains et al. | |
| 5,499,418 | A | 3/1996 | Tan et al. | |
| D369,054 | S | 4/1996 | Straub et al. | |
| D369,934 | S | 5/1996 | Straub et al. | |
| 5,530,974 | A | 7/1996 | Rains et al. | |
| 5,535,467 | A | 7/1996 | Ciske | |
| 5,664,271 | A | 9/1997 | Bellavance | |
| 5,765,502 | A * | 6/1998 | Haugh | 119/28.5 |
| 6,049,929 | A | 4/2000 | Rawson | |
| 6,067,679 | A | 5/2000 | Rice | |
| 6,141,805 | A | 11/2000 | Fisher-Cohen et al. | |
| 6,343,727 | B1 | 2/2002 | Leach | |
| 6,427,251 | B1 | 8/2002 | Leach | |
| 6,484,337 | B1 * | 11/2002 | Moe et al. | 5/652 |
| 6,499,164 | B1 | 12/2002 | Leach | |

(Continued)

*Primary Examiner* — Robert G Santos
*Assistant Examiner* — Richard G Davis
(74) *Attorney, Agent, or Firm* — Mary M. Lee

(57) ABSTRACT

A pillow assembly with multiple configurations. The pillow assembly comprises a first elongate bolster pillow and a second pillow that is either a short cylindrical pillow or a wedge-shaped pillow. The two pillows are connected by an elastic panel, and the bolster pillow can be rolled up inside the elastic panel and snugged up to the side or end of the second pillow in a stowed position.

38 Claims, 13 Drawing Sheets

U.S. PATENT DOCUMENTS

| | | | | |
|---|---|---|---|---|
| 6,553,590 | B1 | 4/2003 | Leach | |
| 6,560,800 | B1 | 5/2003 | Draves | |
| 6,578,218 | B2 | 6/2003 | Wassilefsky | |
| 6,601,252 | B1 | 8/2003 | Leach | |
| 6,704,953 | B2 | 3/2004 | Fishman | |
| 6,751,817 | B1 | 6/2004 | Leach | |
| 6,760,934 | B1 | 7/2004 | Leach | |
| 6,795,990 | B1 | 9/2004 | Hutchinson | |
| 6,802,092 | B1 | 10/2004 | Klein | |
| 6,886,201 | B1 | 5/2005 | Weiss-Lohrei | |
| 7,010,821 | B1 | 3/2006 | Leach | |
| 7,020,918 | B1 | 4/2006 | Tinsley | |
| 7,086,101 | B2 | 8/2006 | Welch et al. | |
| 7,114,206 | B2 | 10/2006 | Leach | |
| 7,117,553 | B2 | 10/2006 | Fairchild et al. | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 7,676,871 | B1 | 3/2010 | Leach | |
| 7,708,342 | B2 | 5/2010 | Leach | |
| 7,793,371 | B1 | 9/2010 | Leach | |
| 7,874,032 | B2 | 1/2011 | North et al. | |
| 7,878,587 | B1 | 2/2011 | Leach | |
| 7,926,135 | B1 | 4/2011 | Leach | |
| 8,136,186 | B1 * | 3/2012 | Leach | 5/631 |
| 2004/0212230 | A1 * | 10/2004 | Hanks | 297/229 |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0277321 | A1 | 12/2007 | Leach | |
| 2011/0119833 | A1 * | 5/2011 | Clark | 5/655 |

* cited by examiner

PILLOW ASSEMBLY WITH MULTIPLE CONFIGURATIONS

FIELD OF THE INVENTION

The present invention relates generally to support pillows.

DETAILED DESCRIPTION OF THE PREFERRED EMBODIMENTS

Figure 2:
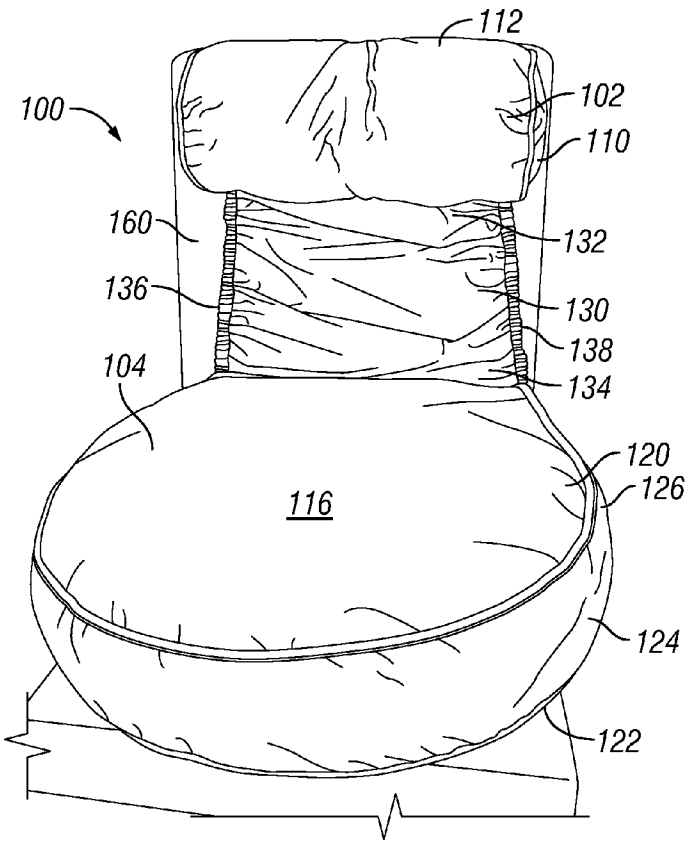
FIG. 2 is a frontal view of the pillow assembly of FIG. 1.

Turning now to the drawings in general and to FIGS. 1-16 in particular, there is shown therein a pillow assembly made in accordance with a first preferred embodiment of the present invention and designated generally by the reference numeral 100. The pillow assembly 100 comprises a first compressible and shape-sustaining pillow 102 and a second compressible and shape-sustaining pillow 104.

The first pillow 102 is in the shape of bolster, that is an elongate cylinder with first and second circular end walls 108 and 110 and cylindrical sidewall 112. The length of the cylindrical sidewall 112 that is greater than its diameter. In this preferred embodiment, the diameter of the sidewall 112 is from about 3.0 inches to about 8.0 inches, and most preferably is about 5.5 inches. The length of the sidewall 112 is about 8.0 to about 16.0 inches, and most preferably is about 12.5 inches.

The second pillow 104 has first and second planar surfaces, such as the first and second circular end walls 116 and 118 each of which is circumscribed by a perimeter 120 and 122. A sidewall 124 extends between the first and second end walls 116 and 118 around at least a portion of the perimeters 120 and 122 of the first and second circular end walls. In this first embodiment, the second pillow 104 preferably is cylindrical. Thus, the sidewall 124 forms a cylinder that extends around the entire perimeters of the first and second end walls 116 and 118 forming first and second circumferential edges 126 and 128 circumscribing the first and second end walls 116 and 118. Most, preferably, the second pillow 104 has the shape of short cylinder, that is, the cylindrical sidewall 124 has a diameter that is greater than its length.

In a preferred embodiment, the diameter of the sidewall 124 is from about 15 inches to about 22 inches, and most preferably is about 18 inches. In this embodiment, the length of the sidewall 124 is about 3 to about 8 inches, and most preferably is about 4.5 inches.

Figure 3:
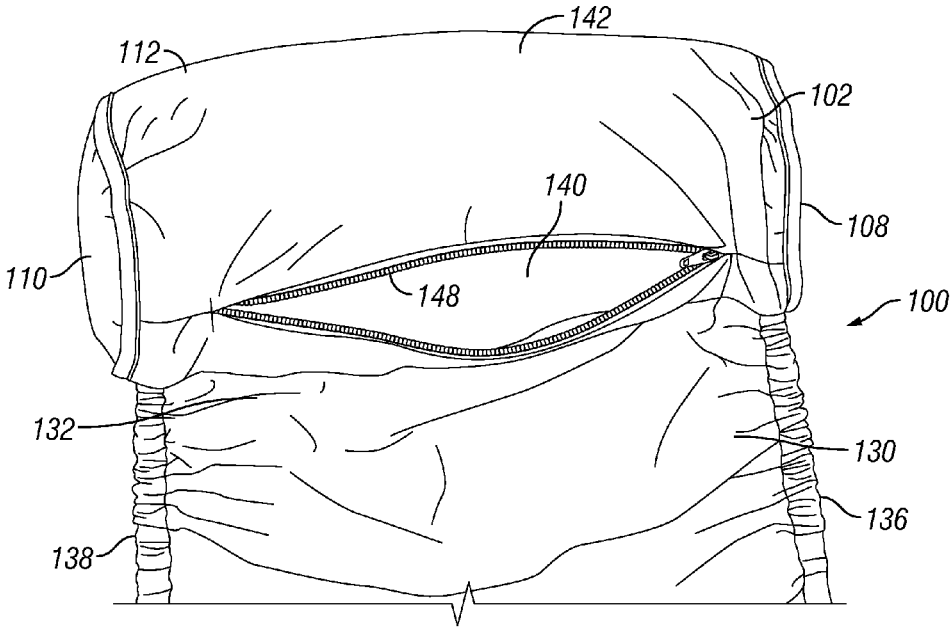
FIG. 3 is rear view of the bolster pillow of the pillow assembly of FIG. 1 showing the zippered opening through which the pillow body is inserted into the pillow cover.
Figure 4:
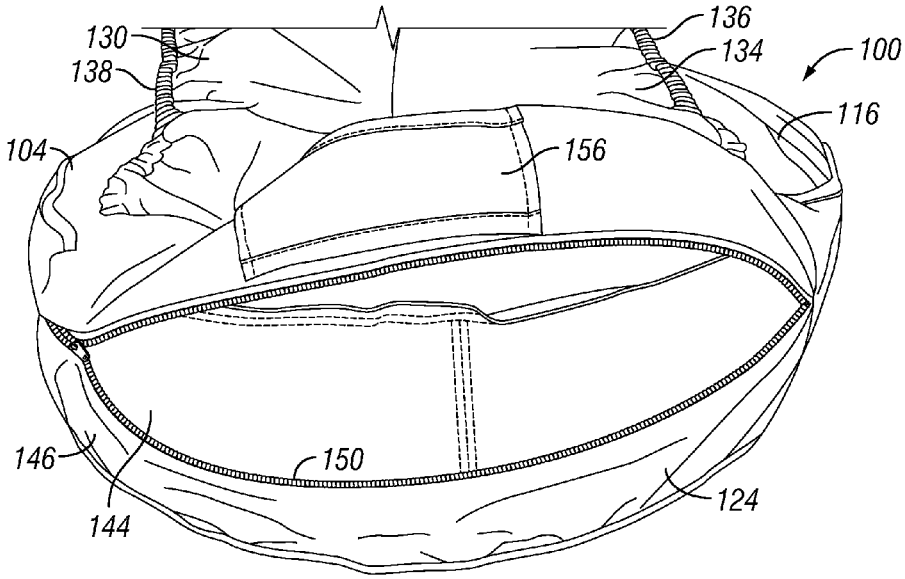
FIG. 4 is a rear view the cylindrical pillow of the pillow assembly of the pillow assembly of FIG. 1 showing the zippered opening through which the pillow body is inserted into the pillow cover.

Still further, the pillow assembly 100 comprises an elastic panel 130. Referring to FIGS. 2-4, the elastic panel has a first end 132 attached lengthwise to the sidewall 112 of the bolster pillow 102 and a second end 134 attached the cylindrical pillow 104. In this embodiment, the second end 134 of the elastic panel 130 attaches along a portion of one of the first and second circumferential edges 124 and 126, such as the edges 124. The ends 132 and 134 as shown herein are permanently attached to the pillows 102 and 104 as by stitching. However, it will be appreciated that a removable attachment means, including but not limited to zippers, or hook-and-look fasteners, ties, snaps, buttons, and hooks, could be utilized instead.

The elastic panel 130 has first and second side edges 136 and 138 that extend between the first and second ends 132 and 134. The elastic panel preferably is a rectangle, that is, preferably the two ends 132 and 134 are parallel to each other and normal to the first and second side edges 136 and 138, which are also parallel. For reasons which will become apparent, the length (the dimension from end 132 to end 134) of the elastic panel 130 preferably is at least about equal to or greater than the circumference of the sidewall 112 of the pillow 102, and the width (the dimension from the edge 136 to the edge 138) of the panel 130 preferably is at least about the same as the length of the sidewall 112 of the pillow 102. However, other shapes and relative dimensions may be employed.

"Elastic" as used herein in reference to the panel 130 denotes the ability to repeatedly stretch or expand and then return to its original length and shape. The elastic panel 130 in the preferred embodiments shown herein is a panel of fabric that is gathered with elastic at both the side edges 136 and 138. Alternately, the panel 130 could be formed of an elastic stretchable material.

As seen in FIG. 3, the pillow 102 preferably comprises a pillow body 140 receivable in a pillow cover 142. Likewise, as shown in FIG. 4, the pillow 104 also preferably comprises a pillow body 144 receivable inside a pillow cover 146. The ends 132 and 134 of the elastic panel 130 then attach to the covers 142 and 146, as shown.

The pillow bodies 140 and 144 typically comprise a fabric enclosure containing a compressible and shape-sustaining filler, such as solid block of firm polyurethane foam in the desired shape. The fabric of the enclosures may be any suitable fabric, including but not limited to waterproof nylon, flannel, or elastic fabrics, such as spandex or cotton-spandex blends. However, presently a polyester/cotton blend is preferred. A preferred filler material for the pillow bodies 140 and 144 is firm polyurethane foam. Other suitable fillers include down feathers, memory foam, and polystyrene pellets. Alternately, the body could be an inflatable enclosure. The covers 142 and 146 may be made of material that is the same as or similar to that used for the inserts. Of course, it should be soft and flexible and washable.

Referring still to FIGS. 3 and 4, the covers 142 and 146 may be removable for cleaning. To that end, the covers 142 and 146 may be provided with closable openings. In the preferred embodiment shown, each of the covers 142 and 146 includes an elongate zippered opening 148 and 150, respectively. However, other types of closures could be substituted for this purpose, such as a simple "sham style" overlapping edge, hook-and-look fasteners, ties, snaps, buttons, and hooks, for example. Although the length and position of the openings may vary, preferably the opening 148 in bolster pillow 102 is about 20 inches, and the opening 150 in the cylindrical pillow 104 is about 20 inches.

A handle 156 (FIG. 4) may be provided for carrying the assembly 100. The size, type and placement of the handle may vary. A preferred handle 156, as shown in FIG. 4, comprises a simple strap affixed to the sidewall 124 of the second pillow 104.

Figure 1:
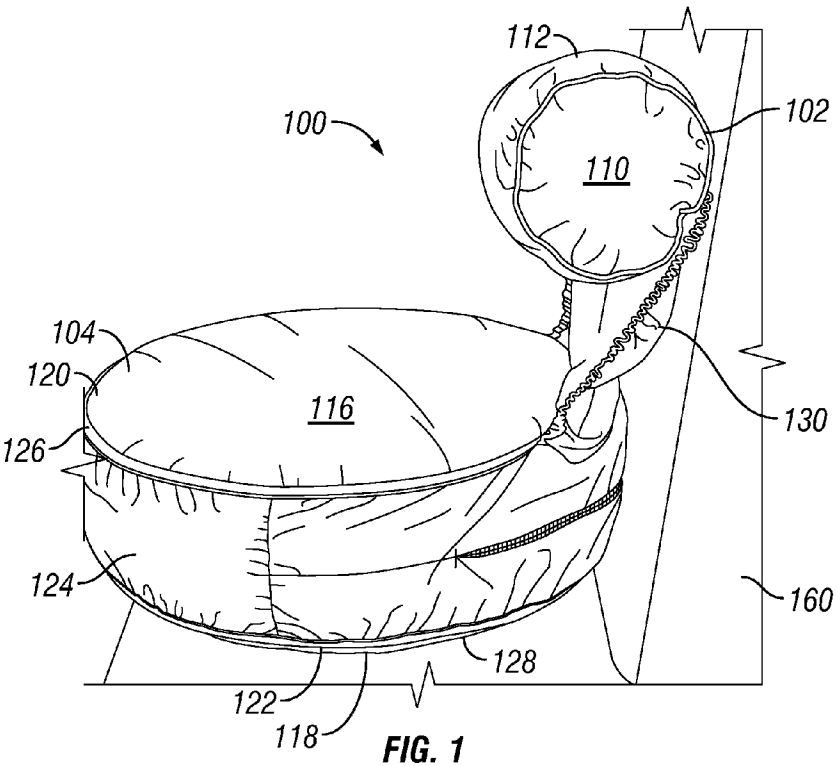
FIG. 1 is a side view of a pillow assembly constructed in accordance with a first preferred embodiment of the present invention. The pillow comprises a bolster pillow connected to a short, cylindrical pillow by an elastic panel. The assembly is shown positioned in a chair.

Having described the construction of the pillow assembly 100, its various configurations and uses now will be explained. FIGS. 1 and 2 illustrate the pillow assembly 100 positioned in a chair 160. The second, cylindrical pillow 104 is positioned in the seat of the chair 160. The elastic panel 130 is unfurled but relaxed and the bolster pillow 102 is positioned across the back of the chair 160. The surface 116 is uppermost, so that the second end 134 of the elastic panel 130 extends from the upper edge 126 in a so-called "topside" position. As thus positioned, the first pillow 102 supports the middle back of an adult user (not shown) and the cylindrical pillow 104 is a seat cushion.

Figure 6:
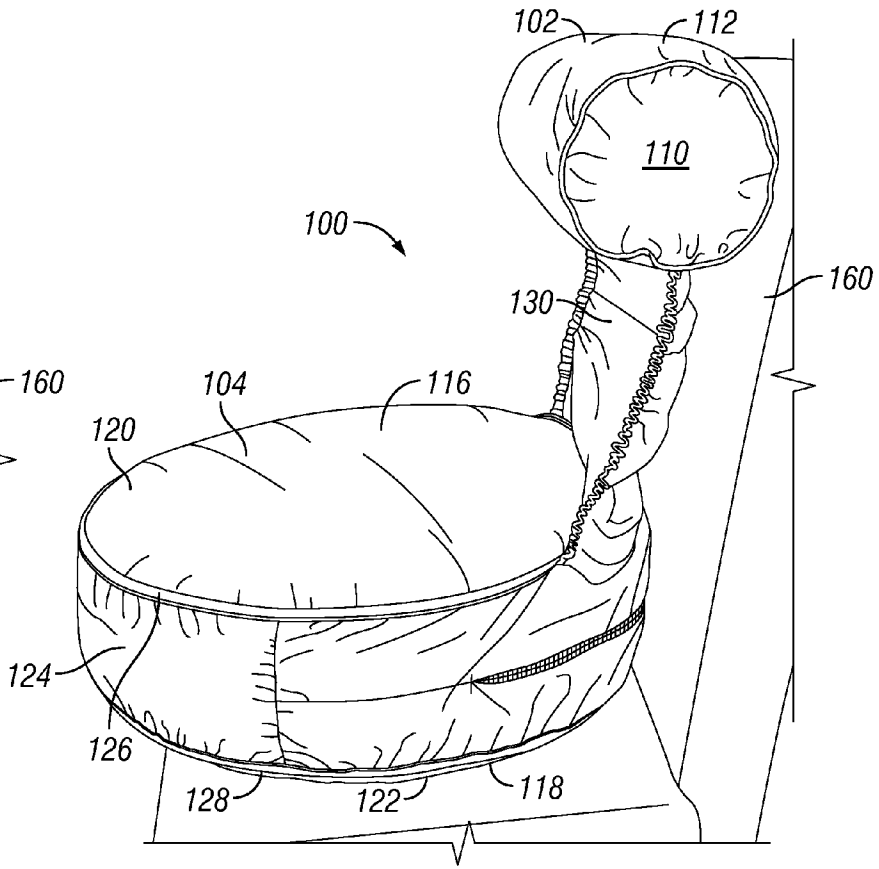
FIG. 6 is side view of the pillow assembly of FIG. 1 showing the bolster pillow spaced above the cylindrical pillow with the elastic panel unfurled and extended and with the bolster pillow positioned to serve as a mid-back support.
Figure 5:
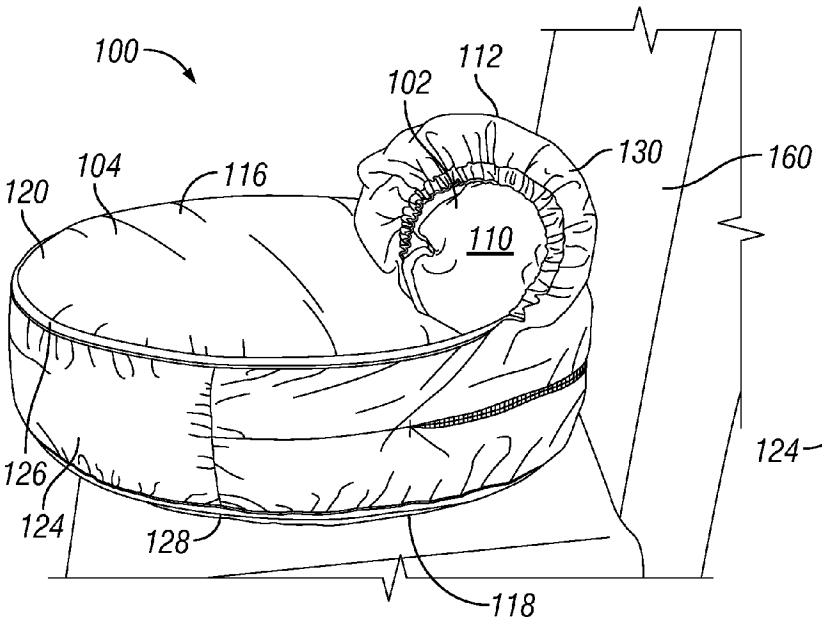
FIG. 5 is a side view of the pillow assembly of FIG. 1 showing the bolster pillow rolled up inside the elastic panel in stowed position to serve as a lower back support.

In FIG. 5, the pillow assembly 100 is positioned in the chair 160 with the bolster pillow 102 in the stowed position inside the furled elastic panel 130. The pillow 102 is rolled toward the end panel 116. In this configuration, the stowed bolster pillow 102 provides lower lumbar support. In FIG. 6, the elastic panel 130 is unfurled and stretched to position the bolster pillow 102 at the upper back area.

When a user is seated on the cylindrical pillow 104 leaning back against the bolster pillow 102, with the pillows positioned as they are in FIGS. 5 and 6, either the bolster pillow 102 or the cylindrical pillow 104, or both, may not lie flush against the back of the chair 160. This is because the lower edge 134 of the panel 130 may be pulled inward in response to the depression of the cylindrical pillow 104. For this reason, some users may find it more comfortable to use the pillow assembly 100 in the "bottomside" arrangement shown in FIG. 7, to which attention now is directed.

Figure 7:
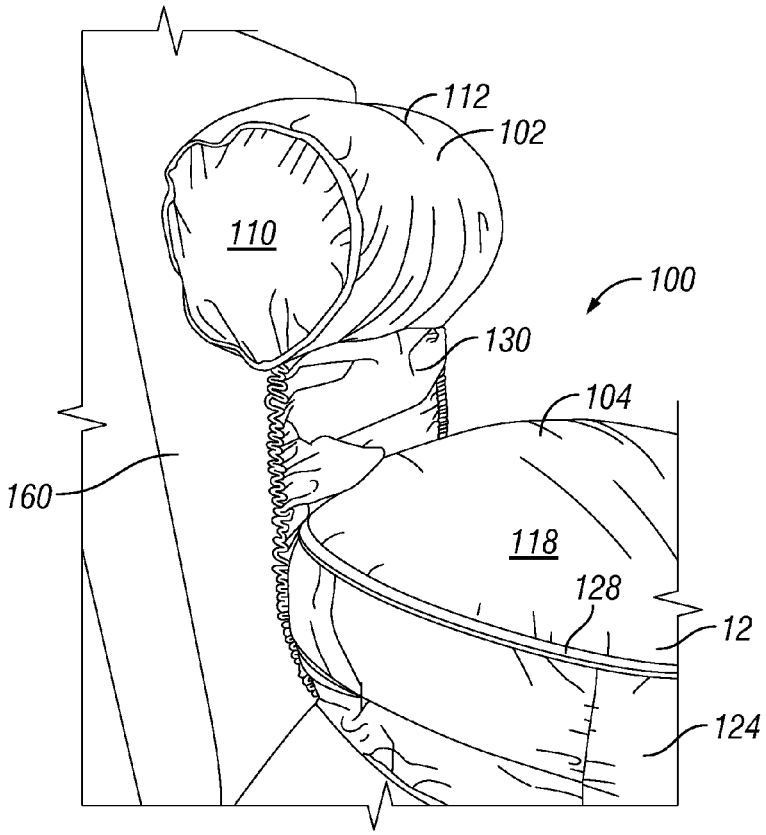
FIG. 7 is a side view of the pillow assembly of FIG. 1 with the cylindrical pillow reversed so that the elastic panel extends from the bottom edge of the cylindrical pillow.

FIG. 7 illustrates the bottomside positioning of the cylindrical pillow 104 with the edge 126 lowermost. This allows the bolster pillow 102 to remain flush against the back of the chair 160, even when the cylindrical pillow 104 is depressed. Additionally, tension on the lower edge 134 of the elastic panel 130 tends to straighten that portion of the curved sidewall 124 at which it attaches. This straightening, allows the back of the cylindrical pillow 104 to fit closely against the chair back. This configuration also allows more variation in the range of positions of the bolster pillow 102. The distance between the bolster pillow 102 and the top panel 118 of the cylindrical pillow 104 with the elastic panel 130 unfurled is less than in the topside arrangement; this allows additional lumbar support from the bolster pillow 102.

Figure 8:
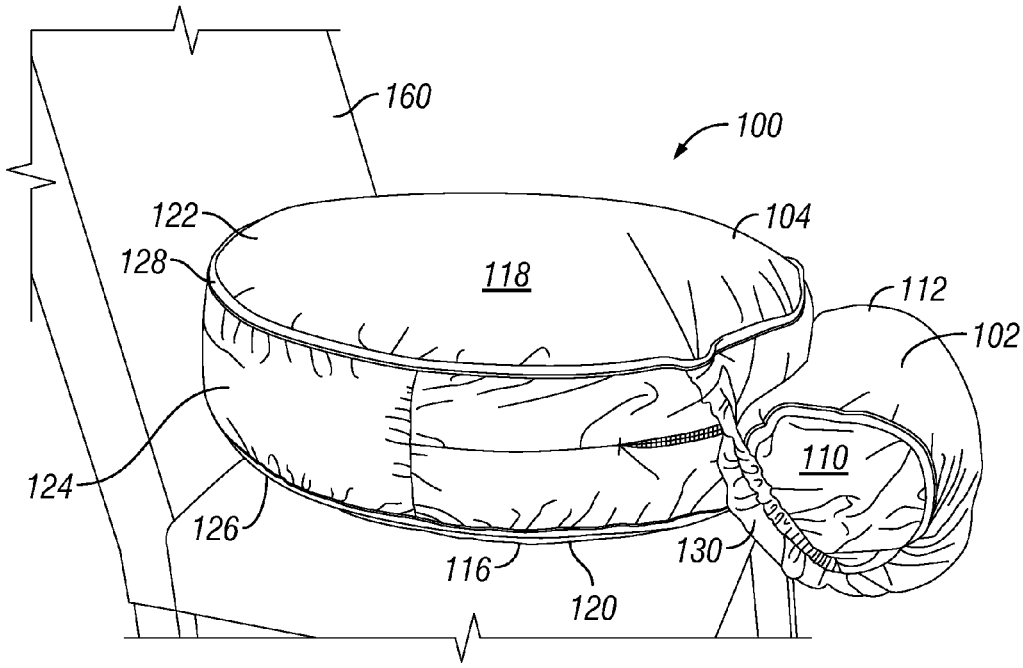
FIG. 8 is a side view of the pillow assembly of FIG. 1 with the cylindrical pillow rotated so that the bolster pillow, stowed in the elastic panel, is positioned at the front edge of the chair.
Figure 10:
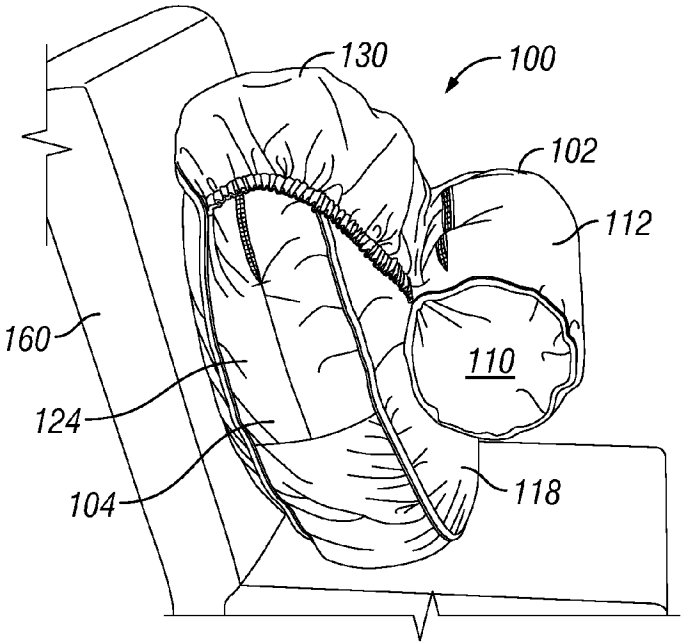
FIG. 10 is a side view of the pillow assembly of FIG. 1 with the cylindrical pillow positioned upright as a back support pillow, the elastic panel unfurled, and the bolster pillow hanging over the front of the cylindrical pillow providing a double depth of support for the back.

Yet another configuration of the pillow assembly 100 is shown FIG. 8. In this arrangement, the bolster pillow 102 is stowed and the pillow 104 is rotated so that the stowed bolster pillow hangs across the front edge of the chair seat. The pillow 104 is shown in the topside position (the elastic panel 130 extends from the edge that is uppermost). The bolster pillow 102 is rolled toward the end panel 116, but is allowed to hand adjacent to the sidewall 124. Alternately, the pillow 102 may rolled toward and stowed against the sidewall 124 (not shown). In either of these positions, the bolster pillow 102 fits under the back of the knees of the user to cushion the back of the legs and displace them slightly forward. This may discourage the development of deep vein thrombosis. Note that in this configuration, the elastic edges 136 and 138 of the elastic panel 130 hold the bolster pillow 102 snugly in position.

Figure 9:
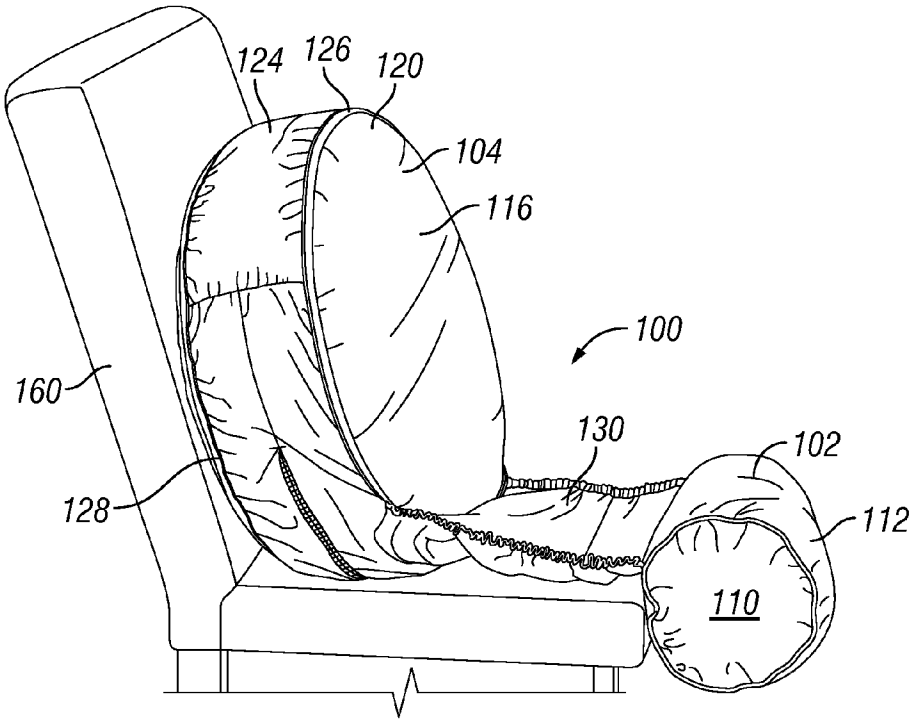
FIG. 9 is side view of the pillow assembly of FIG. 1 with the cylindrical pillow positioned upright as a back support pillow, the elastic panel unfurled, and the bolster pillow hanging over the front edge of the chair.

FIG. 9 illustrates the use of the assembly 100 to provide full back support and under knee support. The cylindrical pillow 104 is positioned upright against the chair back with the end panel 116 forward most. The pillow 104 is rotated so that the end 134 of the elastic panel 130 is adjacent the chair seat. With the elastic panel unfurled, the bolster pillow 102 extends across the front edge of the chair seat to support the user's knees.

In some cases, a double thickness of back support is desired. This may be achieved by positioning the cylindrical pillow 104 upright against the chair back and unfurling the elastic panel 130 across the sidewall 124 and down a distance onto the end panel 118 of the pillow 104. This holds the bolster pillow 102 in the mid back region, while the cylindrical pillow 104 provides full back support.

Figure 11:
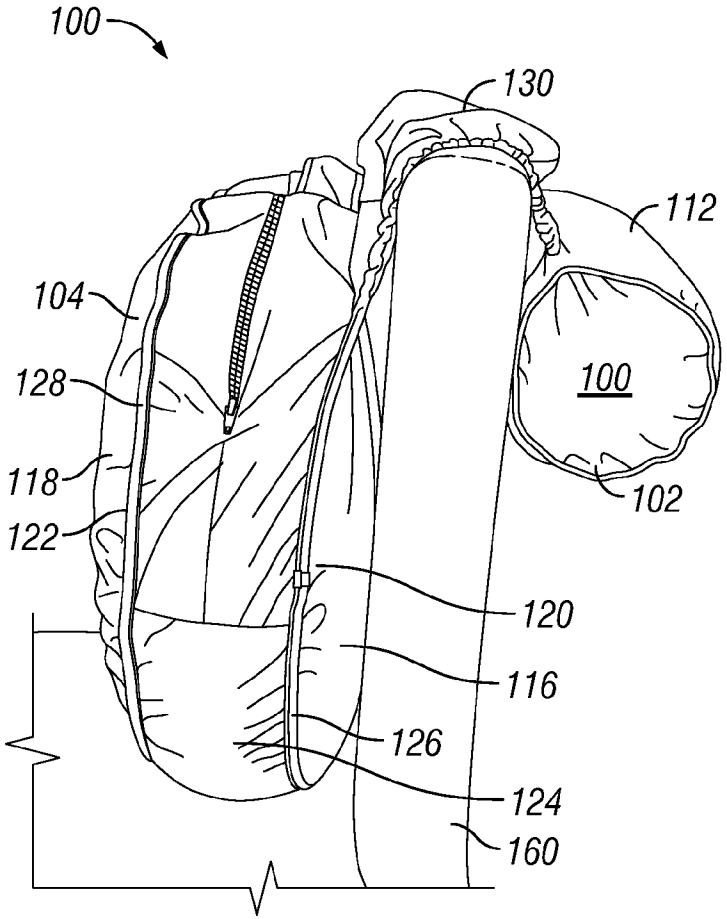
FIG. 11 is a side view of the pillow assembly of FIG. 1 with the cylindrical positioned upright as a back support pillow, the elastic panel unfurled, and the bolster pillow hanging over the back of the chair serving to hold the cylindrical pillow in position.

In FIG. 11, the cylindrical pillow 104 is placed upright against the back of the chair 160 for maximum cushioning of the entire back. The elastic panel 130 is unfurled over the top of the chair back, and is held in place by the bolster pillow 102, which is hanging over the back of the chair 160.

Figure 12:
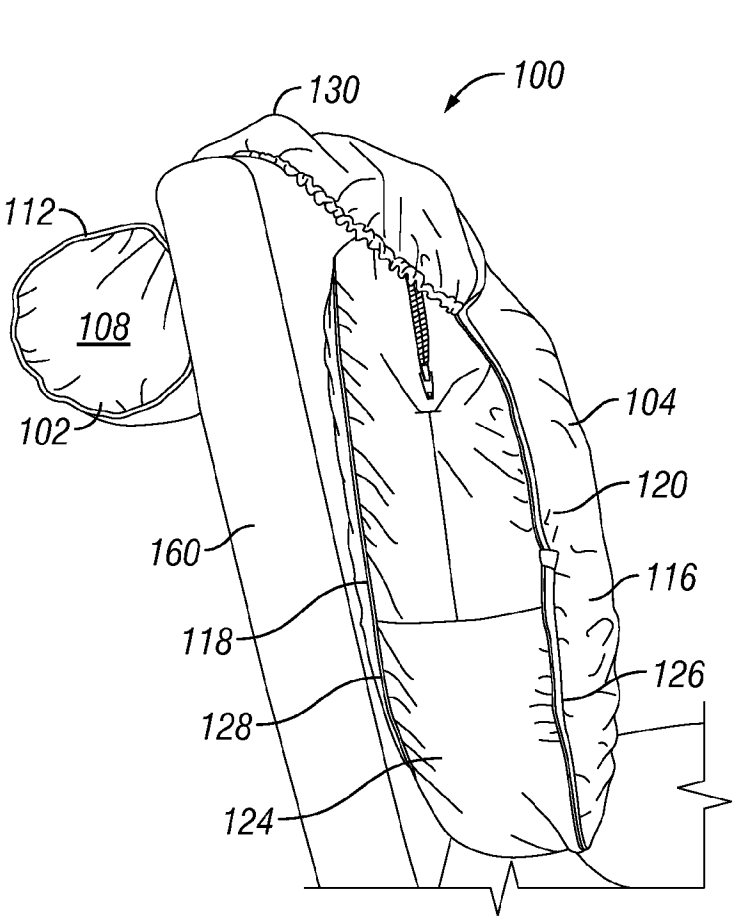
FIG. 12 is a side view of the pillow assembly of FIG. 1 with the cylindrical positioned upright as a back support pillow, the elastic panel unfurled, and the bolster pillow hanging over the back of the chair serving to hold the cylindrical pillow in position. The cylindrical pillow is reversed so that the elastic panel extends from the front edge of the cylindrical pillow.

In FIG. 12, the cylindrical pillow 104 is again placed upright against the back of the chair 160 for maximum cushioning of the entire back. The elastic panel 130 is unfurled over the top of the chair back, and is held in place by the bolster pillow 102, which is hanging over the back of the chair 160. However, in this configuration, the cylindrical pillow 104 is inverted so that the elastic panel 130 extends from the forward most edge.

Figure 13:
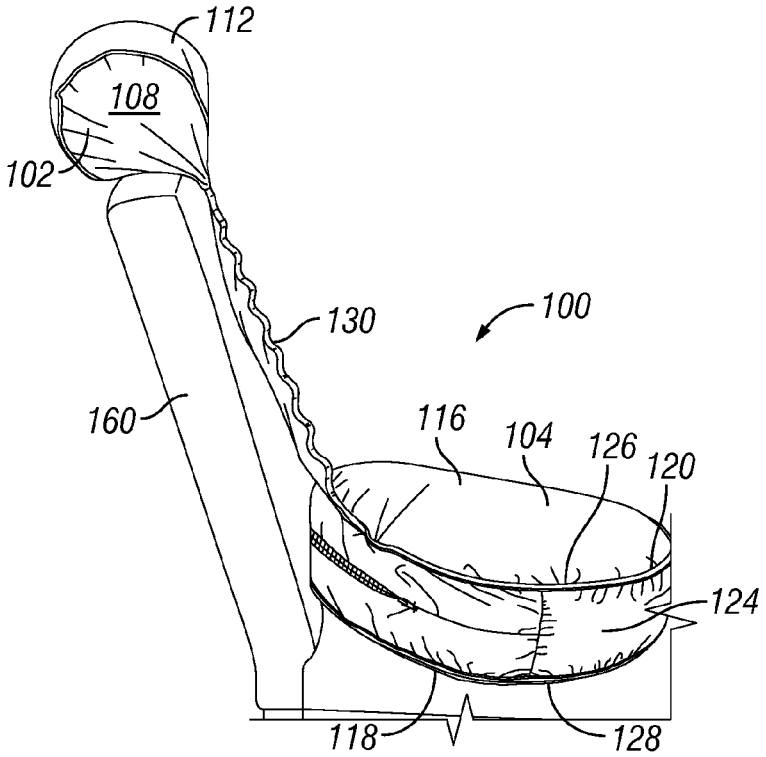
FIG. 13 is a side view of the pillow assembly of FIG. 1 with the cylindrical pillow on the seat of the chair, the elastic panel unfurled and extended, and the bolster pillow positioned at the top of the chair back to serve as a neck support.

FIG. 13 illustrates the bolster pillow 102 in use as a neck support. The cylindrical pillow 104 is in the topside position in the chair seat, and the elastic panel 130 is fully expanded.

Figure 14:
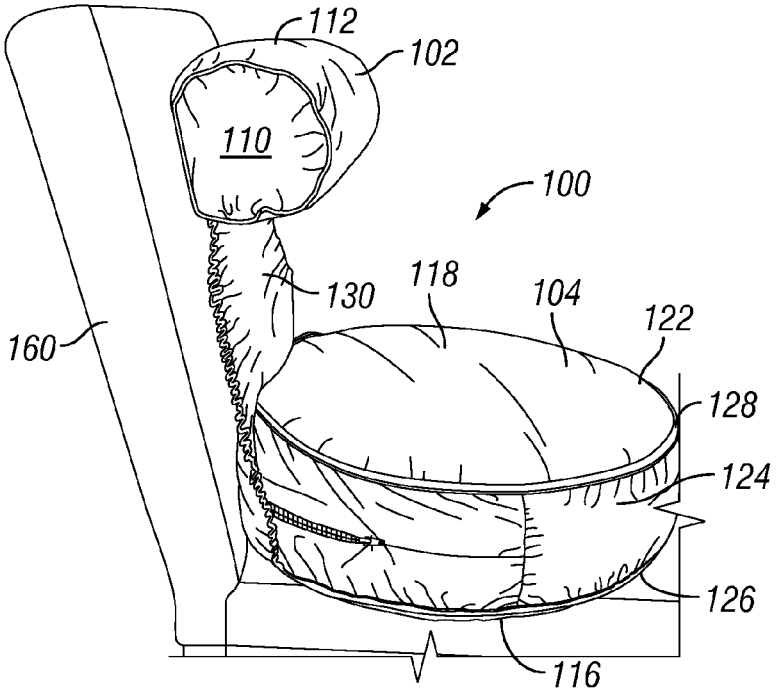
FIG. 14 is a side view of the pillow assembly of FIG. 1 with the cylindrical pillow on the seat of the chair and reversed so that the elastic panel extends from the bottom edge of the cylindrical pillow, the elastic panel unfurled and extended, and the bolster pillow positioned near the top of the chair back to serve as a back support.

FIG. 14 shows the cylindrical pillow in the bottomside position, as in FIG. 7, but the elastic panel 130 is further extended. This illustrates how the user can raise as well as lower the bolster pillow 102 relative to the cylindrical pillow 104, depending on the desired point of support.

Figure 15:
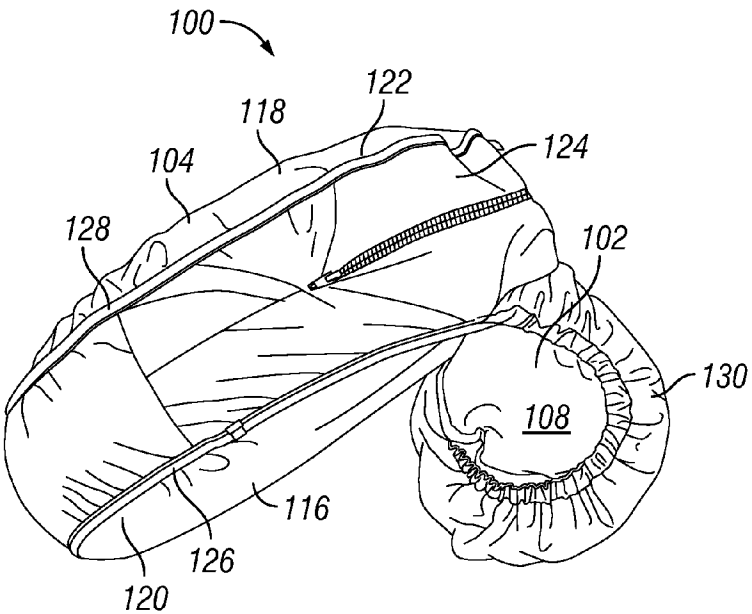
FIG. 15 is a side view of the pillow assembly of FIG. 1 with the bolster pillow in the stowed position. The pillow assembly is positioned with the bolster pillow underneath the cylindrical pillow elevating one side of the cylindrical pillow to provide an inclined support for a person in a reclining position.

The pillow assembly 100 is not limited to use in a chair. As shown in FIG. 15, it may be used on a flat surface, such as a bed. In this arrangement shown in FIG. 15, the bolster pillow 102 is rolled toward and stowed snugly against the end panel 116 of the cylindrical pillow 104. The assembly 100 is then inverted to provide an inclined support. Thus positioned, the pillow assembly 100 may be used to elevate the head and upper body for reading or to prevent acid reflux (GERD). When used under the hips, this configuration can provide relief for the discomfort of hemorrhoids or episiotomy. Still further, this configuration can be used under the knees.

Figure 16:
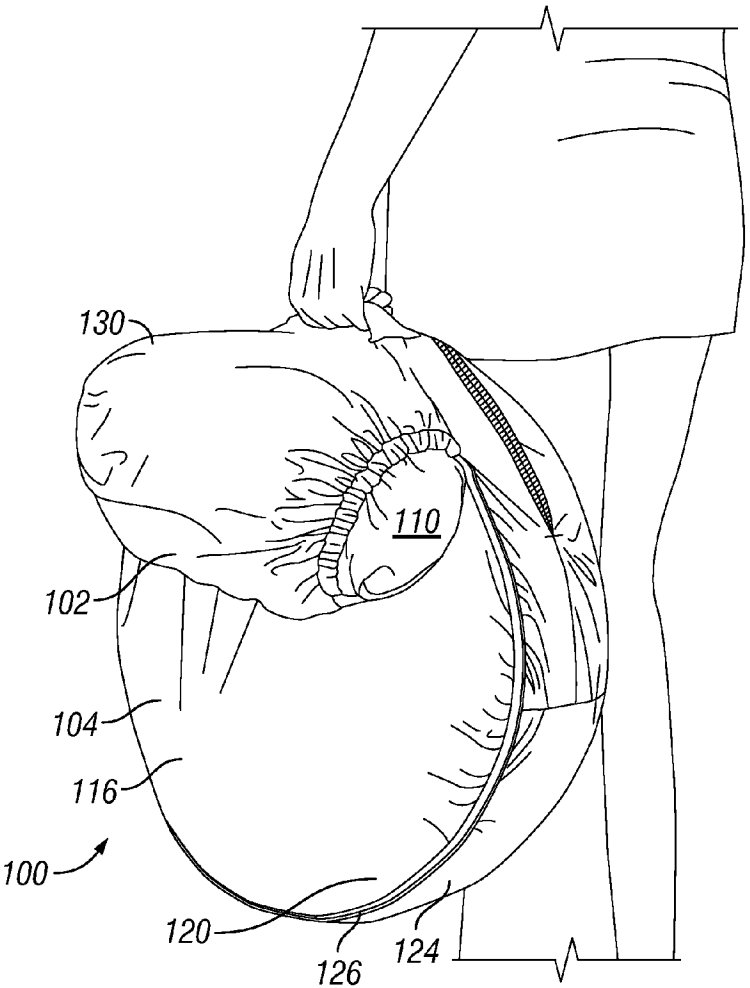
FIG. 16 is a perspective view of the pillow assembly of FIG. 1 with the bolster cushion in the stowed position. The pillow assembly is being carried by a handle on the side of the cylindrical pillow.

The portability of the pillow assembly 100 is depicted in FIG. 16. The bolster pillow 102 is stowed in the furled elastic panel 130 and tucked in snugly against the cylindrical pillow 104. The handle 156 is positioned to maintain the pillow assembly 100 in this position as it is carried.

Turning now to FIGS. 17-26 a second preferred embodiment will be described. This second embodiment, designated generally by the reference number 200, also comprises a first compressible and shape-sustaining pillow 202 and a second compressible and shape-sustaining pillow 204.

The first pillow 202 is in the shape of bolster, as in the first embodiment, having an elongate cylinder with first and second circular end walls 208 and 210 and cylindrical sidewall 212. The length of the cylindrical sidewall 212 that is greater than its diameter, and the dimensions preferably are those of the pillow 102 in the first embodiment.

The second pillow 204 has first and second planar surfaces, such as the first and second panels 216 and 218 each of which is circumscribed by a perimeter 220 and 222. A sidewall 224 extends between the first and second end walls 116 and 118 around at least a portion of the perimeters 220 and 222 of the first and second circular end walls.

In this second embodiment, the second pillow 204 preferably is wedge-shaped. To that end, a first, major portion of the perimeters 220 and 222 of the panels 216 and 218 are curved, and a second, minor portion of the perimeters 220 and 222 of the panels 216 and 218 are straight and joined together forming a knife edge designated at 219. "Knife-edged" as used herein, denotes that the edge is flat or nearly flat.

Although the dimensions may vary, in this preferred embodiment, the width "W" (FIG. 17) of the pillow 204 (from side to side) is between about 14 inches and about 22 inches, and most preferably is about 18 inches. At the widest point, the sidewall 224 is about 4 to about 8 inches, and most preferably is about 6 inches. The length "L" (FIG. 17) of the pillow 204 (from left to right in FIG. 17) is between about 15 inches and about 22 inches, and most preferably is about 18.75 inches.

Figure 17:
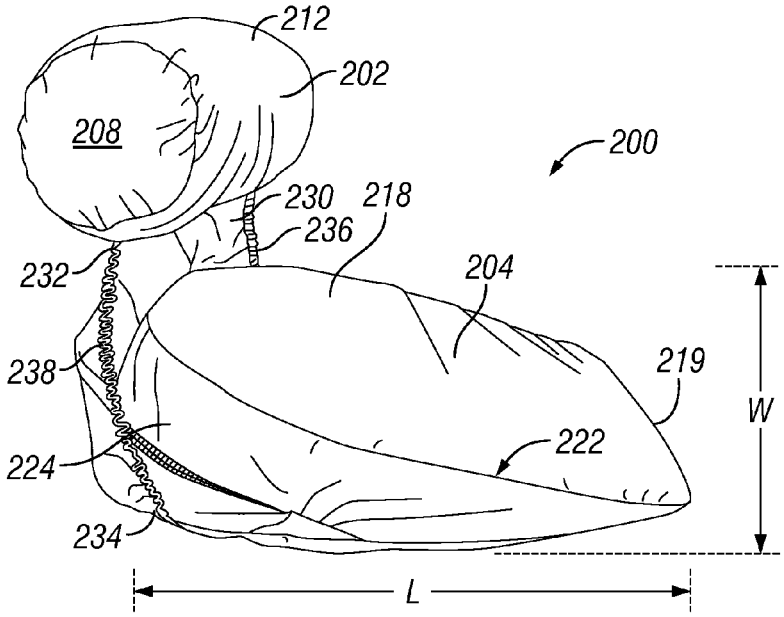
FIG. 17 is a side view of a pillow assembly constructed in accordance with a second preferred embodiment of the present invention. The pillow assembly comprises a bolster pillow connected to a wedge-shaped pillow by an elastic panel. The assembly is shown positioned in a chair with the elastic panel unfurled and the bolster pillow positioned for mid-back support. The wedge-shaped pillow is positioned so the elastic panel extends upward from the bottom edge.
Figure 18:
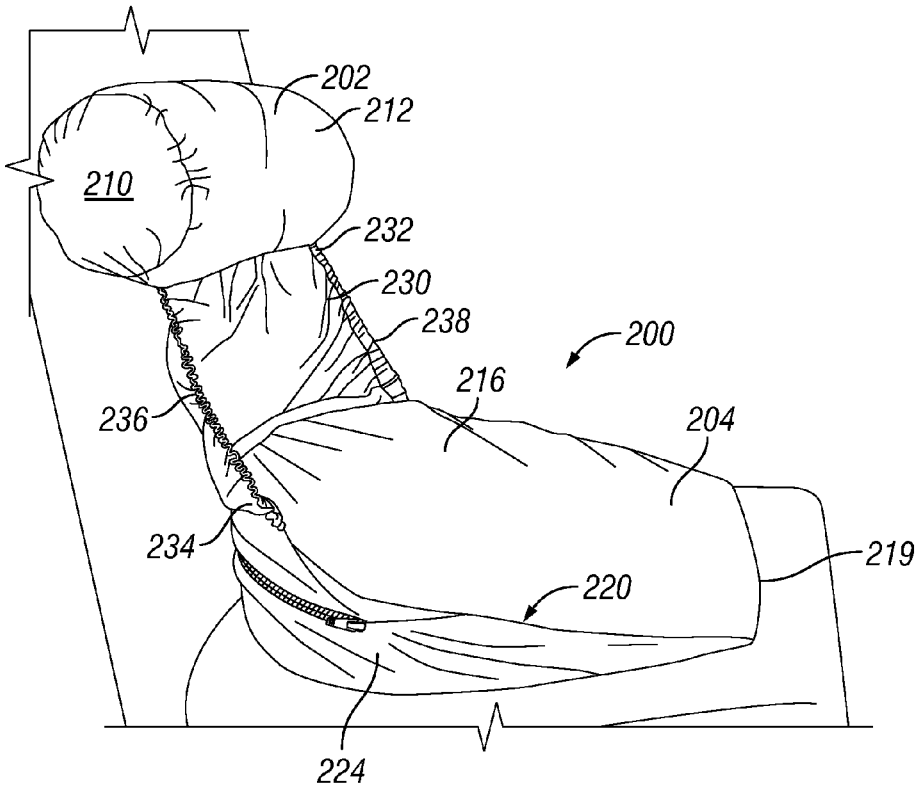
FIG. 18 is side view of the pillow assembly of FIG. 17. The wedge-shaped pillow is positioned so the elastic panel extends upward from the top edge of the wedge-shaped pillow.

Still further, the pillow assembly 100 comprises an elastic panel 230. Referring to FIGS. 17 and 18, the elastic panel 230 has a first end 232 attached lengthwise to the sidewall 212 of the bolster pillow 202 and a second end 234 attached the second, wedge-shaped pillow 204. In this embodiment, the second end 234 of the elastic panel 230 attaches along the middle of the curved portion of one of the first and second panels 216 and 218, such as along the curved perimeter 220 of the panel 216 (FIG. 18). In this position, the first end 232 of the panel 230 is oppositely disposed to the knife edge 219.

The ends 232 and 234 as shown herein are permanently attached to the pillows 202 and 204 as by stitching. However, it will be appreciated that a removable attachment means, such as zippers, or hook-and-look fasteners, ties, snaps, buttons, and hooks, could be utilized instead.

The elastic panel 230 has first and second side edges 236 and 238 that extend between the first and second ends 232 and 234. The elastic panel 230 preferably is a rectangle, that is, preferably the two ends 232 and 234 are parallel to each other and normal to the first and second side edges 236 and 238, which are also parallel. As in the first embodiment, the length (the dimension from end 232 to end 234) of the elastic panel 230 preferably is at least about equal to or greater than the circumference of the sidewall 212 of the bolster pillow 202, and the width (the dimension from the edge 236 to the edge 238) of the panel 230 preferably is at least about the same as the length of the sidewall 212 of the pillow 202. However, other shapes and relative dimensions may be employed.

As in the previous embodiment, the elastic panel 230 preferably comprises a panel of fabric that is gathered with elastic at both the side edges 236 and 238. Alternately, the entire panel 230 could be formed of an elastic material.

Figure 21:
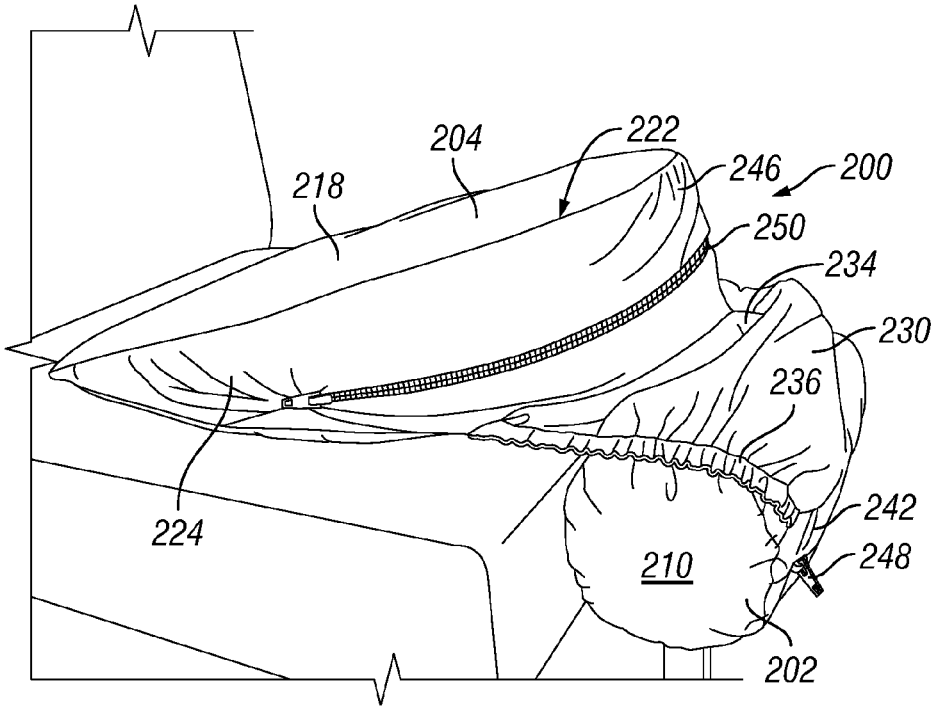
FIG. 21 is a side perspective view of the pillow assembly of FIG. 17 showing the wedge-shaped pillow positioned on the chair seat with the wide end near the front edge of the seat. The bolster pillow is stowed in the unfurled elastic panel and positioned at the front edge of the chair.

As indicate only in FIG. 21, and is in the previous embodiment, the pillows 202 and 204 both preferably comprises a pillow body (not shown) receivable in a pillow cover 242 and 246, respectively, and are similarly constructed except that the second pillow is wedge-shaped with a knife edge instead of generally cylindrical. The covers 242 and 246 also preferably include closable openings, such as the elongate zippered opening 248 and 250, respectively. A handle (not shown) also may be provided for carrying the assembly 200, similar to the handle 156 in the pillow assembly 100.

Having described the construction of the pillow assembly 200, its various configurations and uses now will be explained. FIG. 17 illustrates the pillow assembly 200 with the wedge pillow 204 in the bottom side position, with the second end 234 of the elastic panel 230 extending from the lowermost edge of the curve portion of the sidewall 224. FIG. 18 shows the pillow assembly 200 with the wedge pillow 204 in the reverse or the topside position. In FIG. 18, the pillow assembly 200 shown positioned in a chair 260. In both these configurations, the wedge pillow 204 provides an inclined seat cushion, and the bolster pillow 202 supports the lower and mid back areas, respectively. The thicker, curved side of the pillow 204 relieves pressure on the tail bone, while the knife edge 219 tapers to flush with the front edge of the chair seat.

Figure 19:
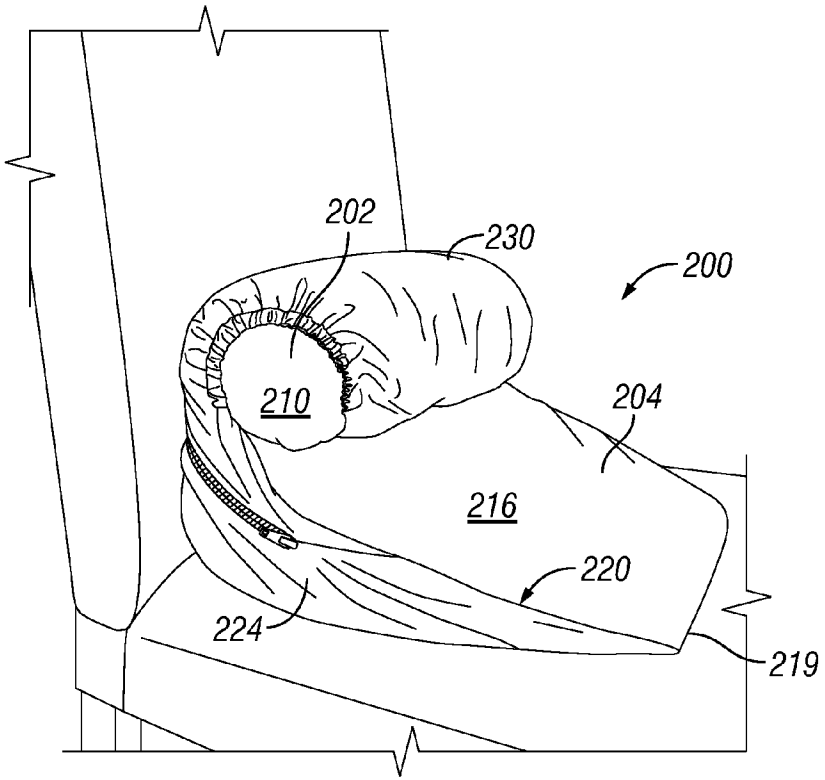
FIG. 19 is a perspective view of the pillow assembly of FIG. 17 showing the bolster pillow stowed inside the unfurled elastic panel with the wedge-shaped pillow positioned so the elastic panel extends upward from the top edge.

FIG. 19 shows how the pillow assembly 200 can be used to provide both elevation to the buttocks and lower lumbar support. The bolster pillow 202 is rolled up inside the furled elastic panel and snugged up against the panel 216.

It will be noted that the pillow assembly 200 in this configuration may also be placed on a flat surface, such as a bed, and there serve as an upper body and neck support or a support for the lower body (hips or knees). Still further, if positioned sideways in a bed, the pillow assembly 200 in this arrangement can serve as belly wedge or back support to a user lying on her side.

Figure 20:
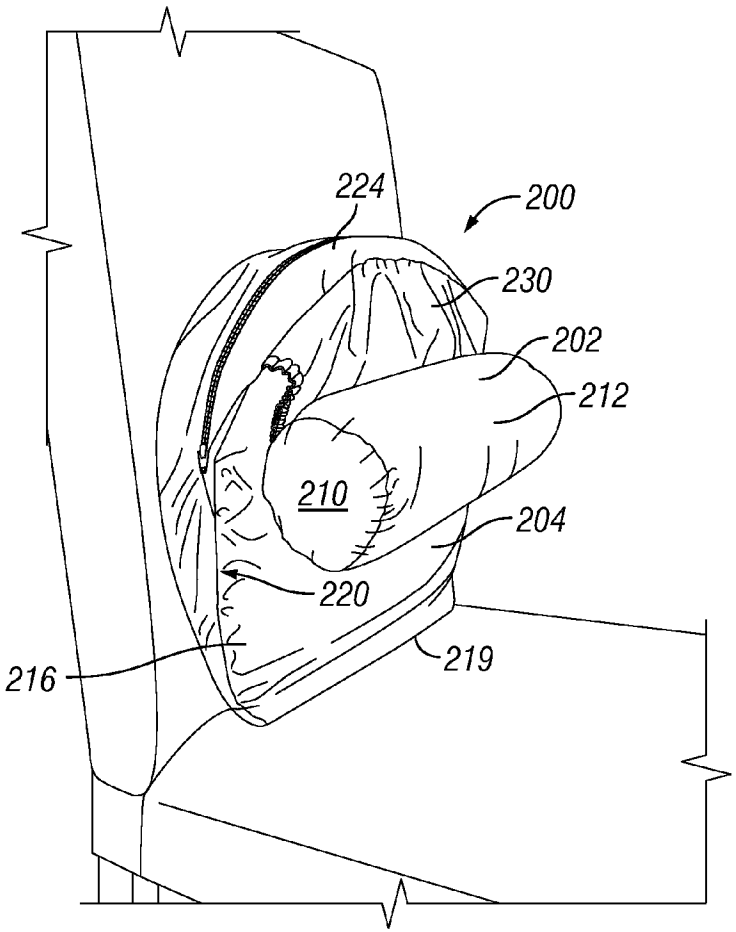
FIG. 20 is a side perspective view of the pillow assembly of FIG. 17 showing the wedge-shaped pillow leaning against the back of the chair. The elastic panel is partially unfurled, and the bolster pillow is positioned in the center of the wedge-shaped pillow for a double thickness of cushioning at the lower back level.

FIG. 20 shows the wedge pillow 204 standing upright on its knife edge 219 with the bolster pillow 202 hanging down in front. This provides a double back cushion.

FIG. 21 displays the pillow assembly 200 with the wedge pillow 204 rotated so the knife edge 219 is adjacent the back of the chair seat and the bolster pillow 202 is adjacent the front of the chair seat. The panel 216 is facing downward, and the elastic panel 230 is partially unfurled. This raises and supports the knees and widens the angle of the bended leg to increase comfort in a sitting position and discourage the development of deep vein thrombosis.

Figure 22:
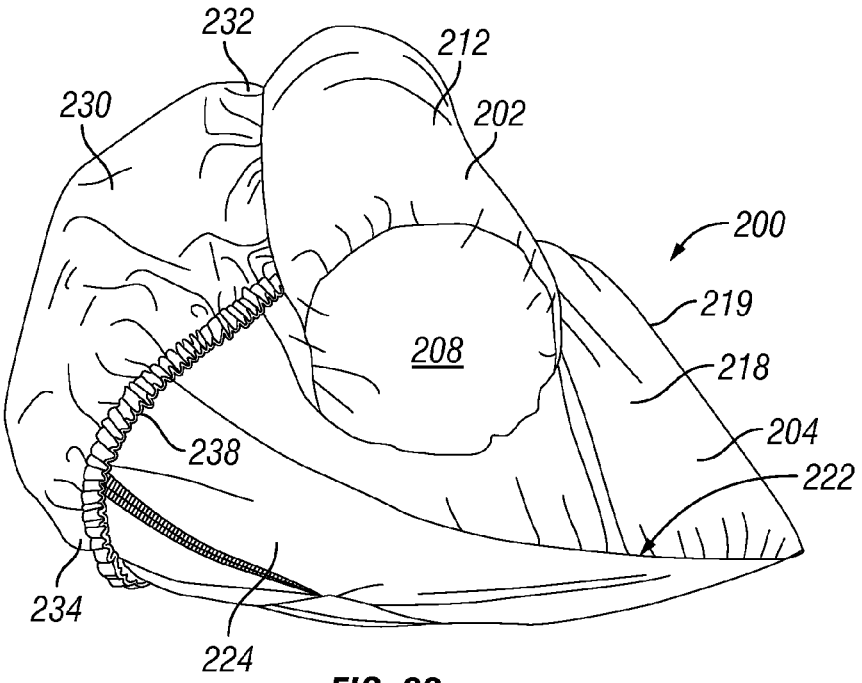
FIG. 22 is a side view of the pillow assembly of FIG. 17 with the wedge-shaped pillow positioned on a flat surface so the elastic panel extends upward from the bottom edge of the wedge-shaped pillow. The elastic panel is unfurled and the bolster pillow is positioned near the middle of the top of the wedge-shaped pillow.

FIG. 22 illustrates another configuration for providing belly support to side-lying user. The wedge pillow 204 is inverted so the panel 218 is uppermost and the elastic panel 230 is deployed up and over the sidewall 224 with the bolster pillow 202 resting on the top of the panel 218. This allows the bolster pillow 202 to provide side support to the belly while the inclined pillow 204 provides support to the belly from underneath.

Figure 23:
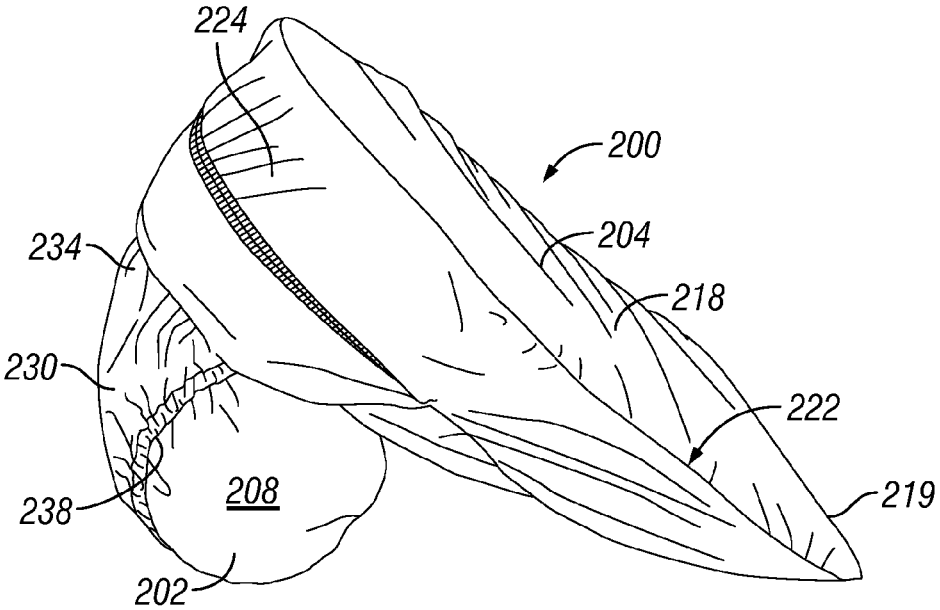
FIG. 23 is a side view of the pillow assembly of FIG. 17 with the wedge-shaped pillow positioned on a flat surface and the bolster pillow stowed in the unfurled elastic panel and positioned at the wide end of the wedge-shaped pillow. The pillow assembly is reversed so that the bolster pillow is underneath the wedge-shaped pillow to prop up the wide end.
Figure 24:
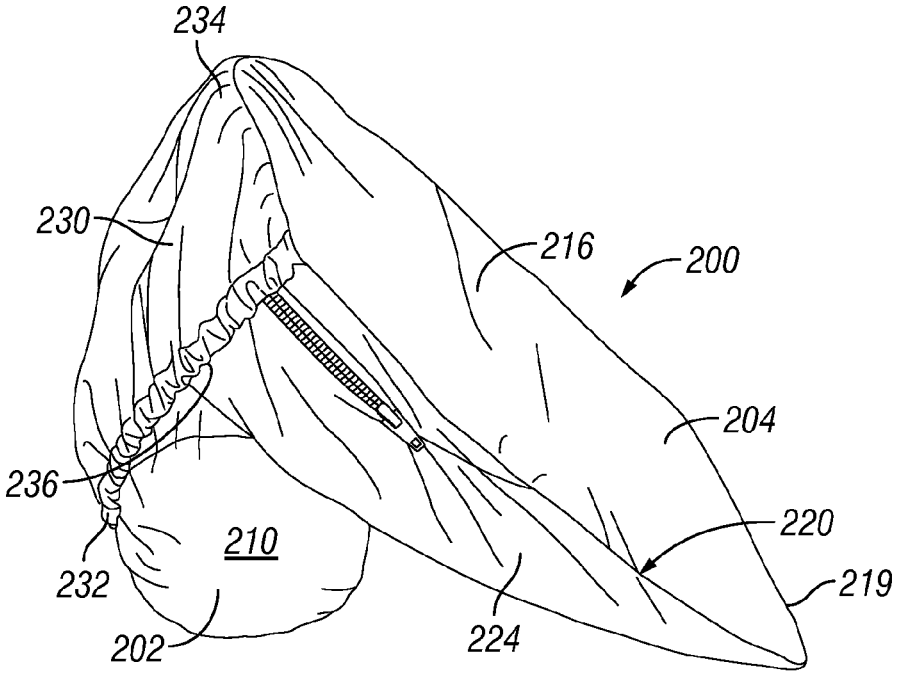
FIG. 24 is a side view of the pillow assembly of FIG. 17 with the wedge-shaped pillow positioned on a flat surface positioned so that the elastic panel extends from the top edge of the wide end of the wedge-shaped pillow. The elastic panel is partially unfurled, and the bolster pillow is positioned under the wide end of the wedge-shaped pillow.

When the maximum elevation or cushioning is desired, the pillow assembly 200 may be configured as shown in FIG. 23 or FIG. 24. In FIG. 23, the bolster pillow 202 is stowed in the furled elastic panel 230, which is snugged up against the panel 216 which is positioned to be the underside, and the assembly is positioned with the pillow 202 underneath the pillow 204. In FIG. 24, the bolster pillow 202 is also positioned under the pillow 204 against the panel 216. However, the wedge pillow 204 is inverted with the panel 216 uppermost and the elastic panel 230 is partially unfurled. In either of these configurations, the pillow assembly 200 may serve as a support for the upper body, lower body, legs and knees, or as a belly support.

Figure 25:
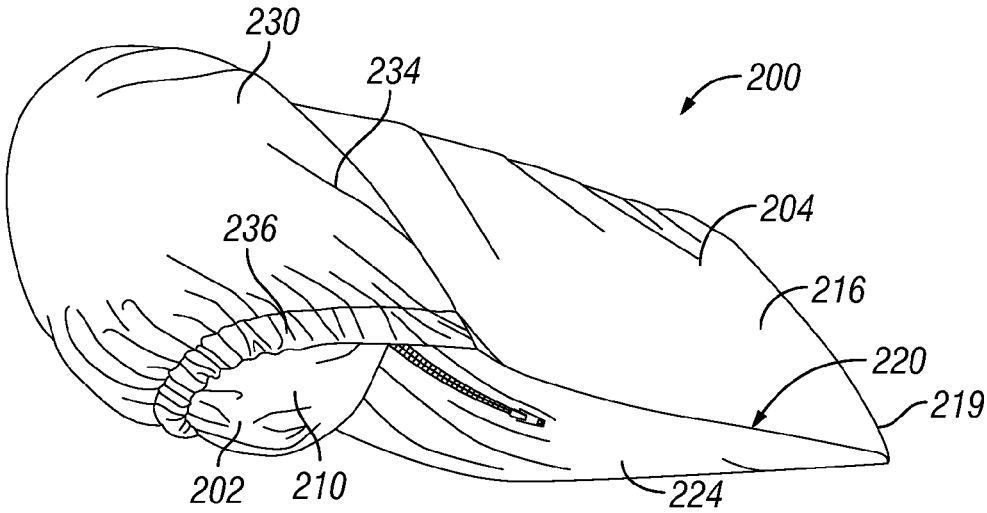
FIG. 25 is a side view of the pillow assembly of FIG. 17 with the wedge-shaped pillow positioned on a flat surface and the bolster pillow stowed in the unfurled elastic panel, which is rolled toward the side of the wedge-shaped pillow. This positions the bolster alongside the wide end of the wedge-shaped pillow, providing an extended support surface.

FIG. 25 illustrates yet another configuration for providing belly support to side-lying user. The bolster pillow 202 is rolled up inside the elastic panel 230, but it is rolled toward the sidewall 224 instead of toward the side panel 216. This positions the stowed bolster pillow 202 up against the curved side of the pillow 204, providing an extension of the support panel 216.

Figure 26:
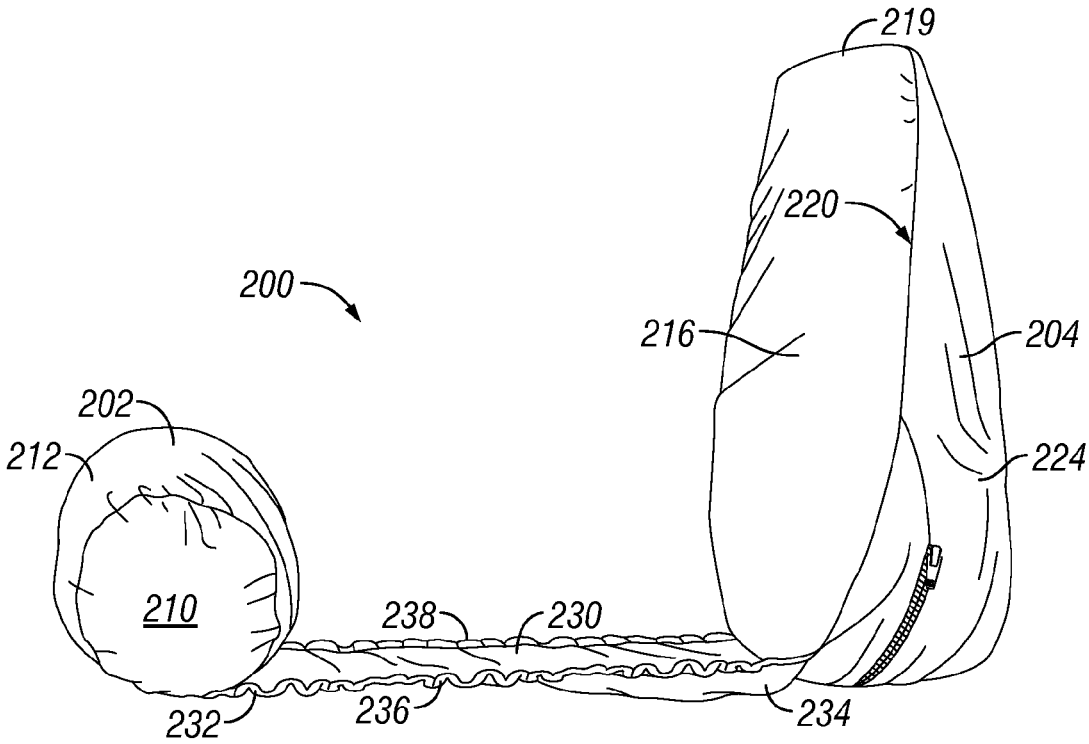
FIG. 26 is a side view of the pillow assembly of FIG. 17 with the elastic panel unfurled and the wedge-shaped pillow positioned upright to stand on its wide end.

FIG. 26 illustrates the position of the pillow assembly 200 providing front and back support for a side-lying user. The upright wedge pillow 204 supports the back, while the bolster pillow 202 supports the belly. The elastic panel 230 extending under the side of the user and maintaining the positioning of the two spaced apart pillows 202 and 204.

Now it will be appreciated that the present invention provides a pillow assembly with many possible configurations. The versatile pillow assembly may be used for support when sitting and reclining. It is will provide relief to individuals suffering from temporary or chronic discomfort from recent childbirth, especially with a healing episiotomy, hemorrhoids, leg cramps, gastro-esophageal reflux disease, and others. Additionally, it is a useful cushioning aid for those taking long distance trips in automobiles or airplanes, as well as those whose daily activities require prolonged sitting at a desk or other work station. Still further, it serves as a handy and adjustable study or reading pillow for the young and healthy.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow assembly comprising:

a first compressible, shape-sustaining bolster pillow having the shape of an elongate cylinder with two circular end walls and a cylindrical sidewall and having a length that is greater than its diameter;

a second compressible, shape-sustaining pillow having a first planar surface circumscribed by a perimeter and a second planar surface circumscribed by a perimeter and a sidewall extending between the first and second planar surfaces around a least a portion of the perimeters; and an elastic panel having a first end attached lengthwise to the sidewall of the bolster pillow and a second end attached to the sidewall of the second pillow, wherein the elastic panel has a length that is at least about the same as the circumference of the bolster pillow and a width that is at least about the same as the length of the bolster pillow, whereby the elastic panel is furlable around the bolster pillow.

2. The pillow assembly of claim 1 wherein the second pillow is a cylindrical pillow in the shape of a short cylinder with first and second circular end walls forming the first and second planar surfaces, wherein the sidewall is cylindrical, and wherein the diameter of the second pillow is greater than the length of the sidewall.

3. The pillow assembly of claim 2 wherein the second pillow comprises first and second circumferential edges circumscribing the first and second circular end walls, respectively.

4. The pillow assembly of claim 3 wherein the second end of the elastic panel is attached along a portion of one of the first and second circumferential edges.

5. The pillow assembly of claim 1 wherein the second pillow is wedge-shaped.

6. The pillow assembly of claim 5 wherein a portion of the perimeter of the first planar surface and a portion of the perimeter of the second planar section join to form a knife edge having first and second ends and wherein the sidewall extends between the first and second ends of the knife edge.

7. The pillow assembly of claim 6 wherein a portion of the sidewall is curved.

8. The pillow assembly of claim 7 wherein the second end of the elastic panel attaches to the second pillow on the curved portion of the sidewall.

9. The pillow assembly of claim 8 wherein the second end of the elastic panel attaches along a portion of the perimeter of one of the first and second planar surfaces.

10. The pillow assembly of claim 9 wherein the second end of the elastic panel attaches along a portion of the perimeter that is oppositely disposed to the knife edge.

11. The pillow assembly of claim 1 wherein the elastic panel comprises a panel of nonelastic fabric with elastically gathered side edges extending between the first and second ends.

12. The pillow assembly of claim 11 wherein the elastic panel is rectangular.

13. The pillow assembly of claim 1 wherein the first and second pillows each comprises a pillow body with a removable cover.

14. The pillow assembly of claim 13 wherein the elastic panel attaches to the removable covers of the first and second pillows.

15. The pillow assembly of claim 1 wherein the elastic panel is rectangular.

16. The pillow assembly of claim 1 wherein pillow assembly comprises a handle.

17. The pillow assembly of claim 16 wherein the handle is attached to the sidewall of the second pillow.

18. The pillow assembly of claim 1 wherein the first end of the elastic panel is permanently attached to the first pillow.

19. The pillow assembly of claim 18 wherein the second end of the elastic panel is permanently attached to the second pillow.

20. The pillow assembly of claim 1 wherein the second end of the elastic panel is permanently attached to the second pillow.

21. A pillow cover assembly comprising:

a first pillow cover configured to conformingly receive a first bolster pillow having the shape of an elongate cylinder with two circular end walls and a cylindrical sidewall and having a length that is greater than its diameter, the first pillow cover correspondingly having two end walls and a cylindrical sidewall with a length that is greater than its diameter;

a second pillow cover configured to conformingly receive a second pillow comprising a first planar surface circumscribed by a perimeter and a second planar surface circumscribed by a perimeter and a sidewall extending between the first and second planar surfaces around a least a portion of the perimeters, the second pillow cover correspondingly having a first planar surface circumscribed by a perimeter and a second planar surface circumscribed by a perimeter and a sidewall extending between the first and second planar surfaces around a least a portion of the perimeters; and an elastic panel having a first end attached lengthwise to the sidewall of the first pillow cover and a second end attached to the sidewall of the second pillow cover, wherein the elastic panel has a length that is at least about the same as the circumference of the first pillow cover and a width that is at least about the same as the length of the first pillow cover, whereby the elastic panel is furlable around the first pillow cover when it contains the bolster pillow.

22. The pillow cover assembly of claim 21 wherein the second pillow is a cylindrical pillow in the shape of a short cylinder with first and second circular end walls forming the first and second planar surfaces, wherein the sidewall is cylindrical, and wherein the diameter of the second pillow is greater than the length of the sidewall.

23. The pillow cover assembly of claim 22 wherein the second pillow comprises first and second circumferential edges circumscribing the first and second circular end walls, respectively.

24. The pillow cover assembly of claim 23 wherein the second end of the elastic panel is attached along a portion of one of the first and second circumferential edges of the second pillow cover.

25. The pillow cover assembly of claim 21 wherein the second pillow is wedge-shaped.

26. The pillow cover assembly of claim 25 wherein the second pillow is shaped so that a portion of the perimeter of the first planar surface and a portion of the perimeter of the second planar section join to form a knife edge having first and second ends and wherein the sidewall extends between the first and second ends of the knife edge.

27. The pillow cover assembly of claim 26 wherein a portion of the sidewall is curved.

28. The pillow cover assembly of claim 27 wherein the second end of the elastic panel attaches to the second pillow cover on the curved portion of the sidewall.

29. The pillow cover assembly of claim 28 wherein the second end of the elastic panel attaches along a portion of the perimeter of one of the first and second planar surfaces of the second pillow cover.

30. The pillow cover assembly of claim 29 wherein the second end of the elastic panel attaches along a portion of the perimeter of the second pillow cover that is oppositely disposed to the knife edge.

31. The pillow cover assembly of claim 21 wherein the elastic panel comprises a panel of nonelastic fabric with elastically gathered side edges extending between the first and second ends.

32. The pillow cover assembly of claim 31 wherein the elastic panel is rectangular.

33. The pillow cover assembly of claim 21 wherein the elastic panel is rectangular.

34. The pillow cover assembly of claim 21 wherein pillow cover assembly comprises a handle.

35. The pillow cover assembly of claim 34 wherein the handle is attached to the sidewall of the second pillow cover.

36. The pillow cover assembly of claim 21 wherein the first end of the elastic panel is permanently attached to the first pillow.

37. The pillow assembly of claim 36 wherein the second end of the elastic panel is permanently attached to the second pillow.

38. The pillow cover assembly of claim 21 wherein the second end of the elastic panel is permanently attached to the second pillow.

* * * * *